US005346135A

United States Patent [19]

Vincent

[11] Patent Number: 5,346,135

[45] Date of Patent: Sep. 13, 1994

[54] SPRAYING APPARATUS FOR BLENDING LIQUIDS IN A GASEOUS SPRAY SYSTEM

[76] Inventor: Edward C. Vincent, 247 S. Kenilworth Ave., Oak Park, Ill. 60302-3115

[21] Appl. No.: 899,252

[22] Filed: Jun. 16, 1992

[51] Int. Cl.[5] ..... B05B 7/08; B05B 7/12

[52] U.S. Cl. ..... 239/306; 239/307; 239/314; 239/335; 239/341

[58] Field of Search ..... 239/304, 306, 307, 314, 239/335, 375, 341; 222/145, 630

[56] References Cited

U.S. PATENT DOCUMENTS

| | | | |
|---|---|---|---|
| 651,046 | 6/1900 | Leggett . | |
| 912,106 | 2/1909 | Frazier . | |
| 1,082,159 | 12/1913 | Kelley . | |
| 1,270,553 | 6/1918 | Rouge . | |
| 1,652,422 | 7/1924 | Ascherl . | |
| 1,863,782 | 6/1930 | Young . | |
| 1,948,401 | 2/1934 | Smith et al. . | |
| 2,136,024 | 11/1939 | Schneider . | |
| 2,148,047 | 2/1939 | Epstein | 239/306 |
| 2,240,401 | 4/1941 | Jordan | 239/341 |
| 2,757,048 | 6/1956 | Balmer | 239/306 |
| 3,084,870 | 4/1963 | Hagadorn . | |
| 3,180,578 | 4/1965 | Hagadorn . | |
| 3,297,209 | 1/1967 | Pungitore . | |
| 3,298,611 | 1/1967 | Marraffino et al. . | |
| 4,508,271 | 4/1985 | Gress . | |
| 4,546,922 | 10/1985 | Thometz . | |
| 4,714,084 | 12/1987 | Berry et al. . | |

FOREIGN PATENT DOCUMENTS 1070911 2/1954 France .

*Primary Examiner*—Andres Kashnikow
*Assistant Examiner*—Lesley D. Morris
*Attorney, Agent, or Firm*—Gerlach & O'Brien

[57] ABSTRACT

A spraying apparatus adapted for blending liquids in a gaseous spray stream includes a gas nozzle that is adapted for discharging a gas jet to be directed at an object to be sprayed, and a plurality of liquid nozzles having suction outlets adapted for removal of liquid therefrom by aspiration, the liquid nozzles being mounted for disposing them relative to the gas jet to effect aspiration of liquid from their outlets together into the gas jet for spraying an object with the resulting spray mixture, at least one of the gas nozzle and a liquid nozzle being mounted for varying the disposition of the liquid nozzle relative to the gas jet to thereby vary the rate of aspiration from the outlet of such liquid nozzle relative to the rate of aspiration from the outlet of another liquid nozzle. In preferred embodiments, hand-held apparatus, useful in an airbrush assembly, also includes a support upon which the gas nozzle and the liquid nozzles are mounted, and liquid containers mounted on the support for supplying liquid to be sprayed, such as paint in different colors, to the liquid nozzles, for blending the liquids together in varying desired ratios.

7 Claims, 2 Drawing Sheets

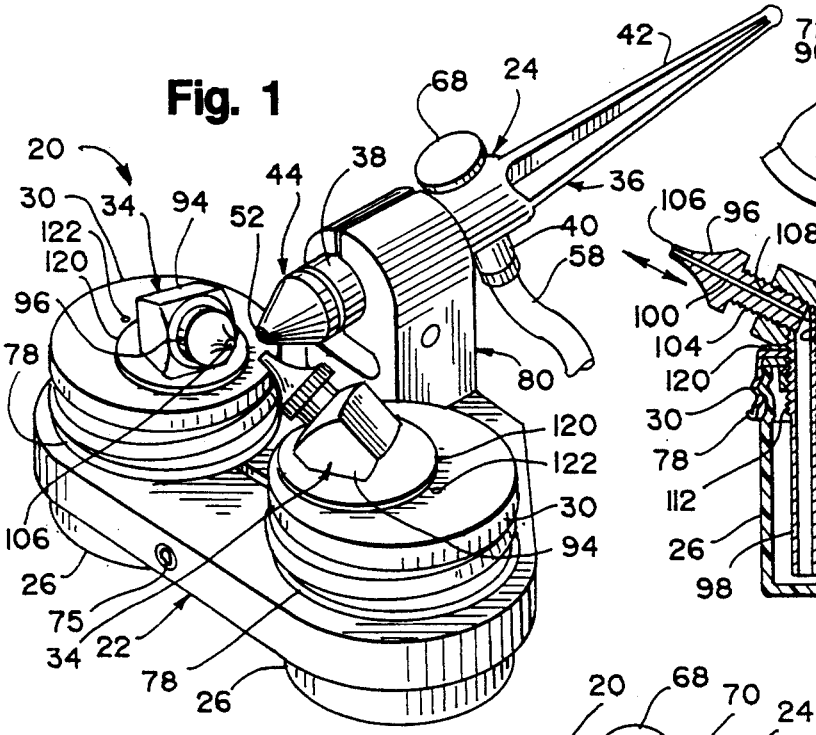
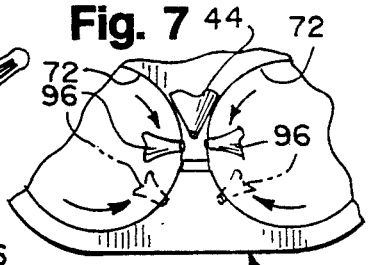
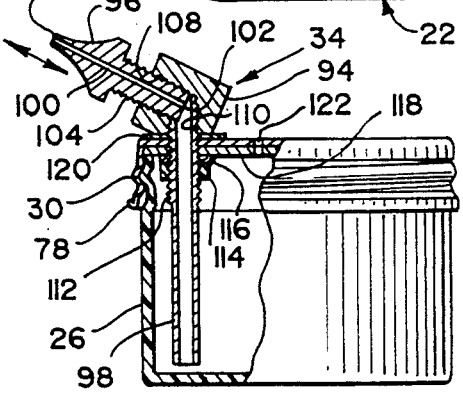
Fig. 6
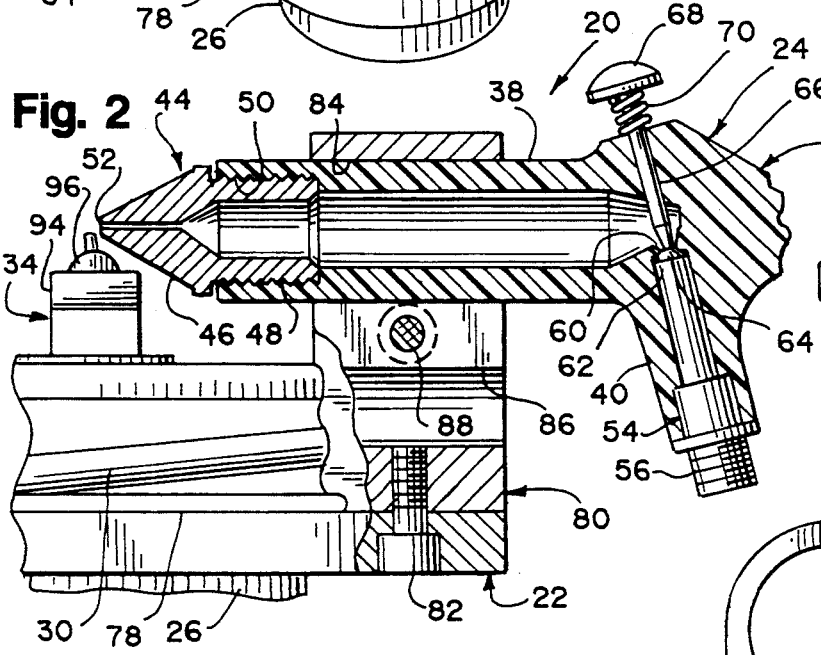
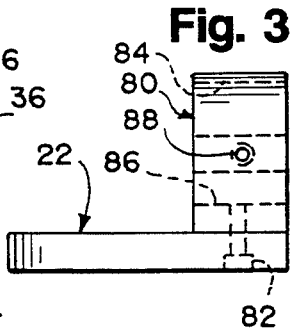
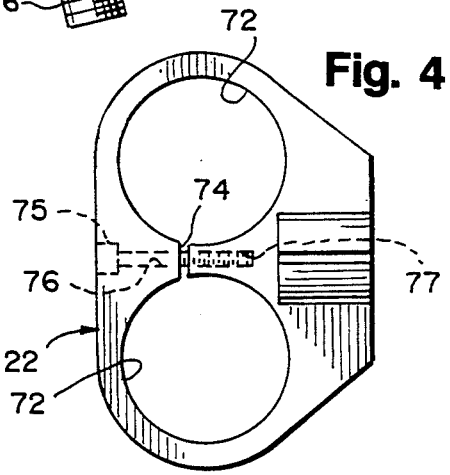
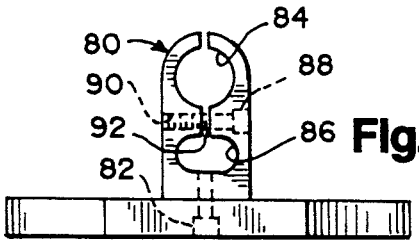

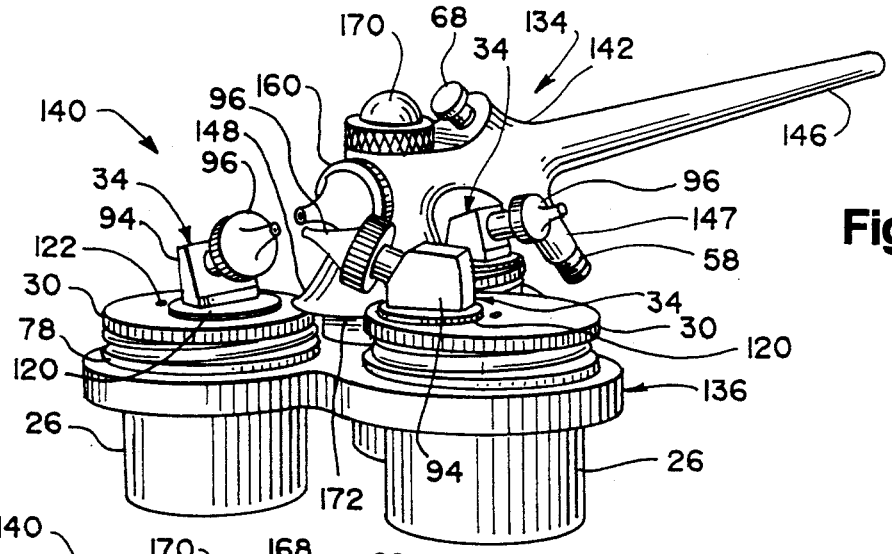
Fig. 8
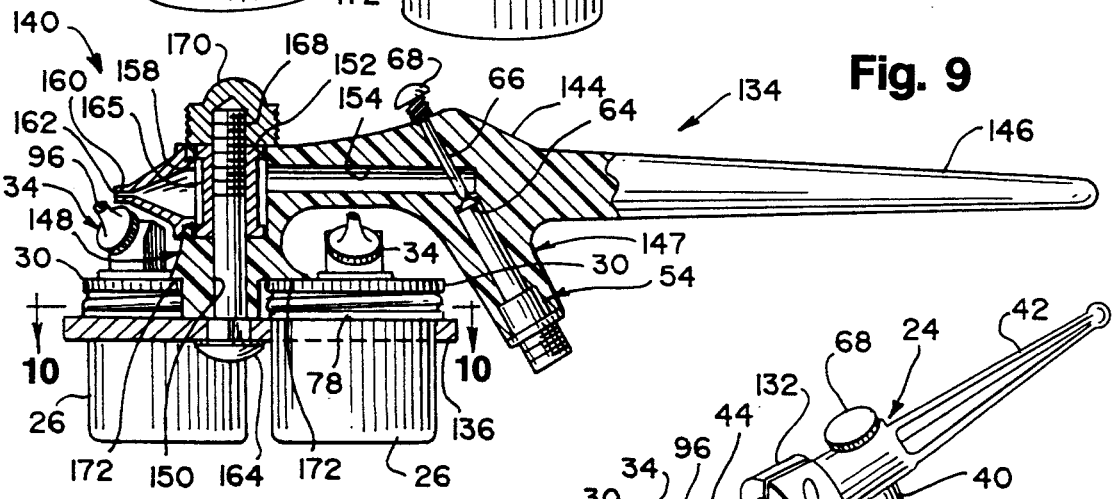
Fig. 9
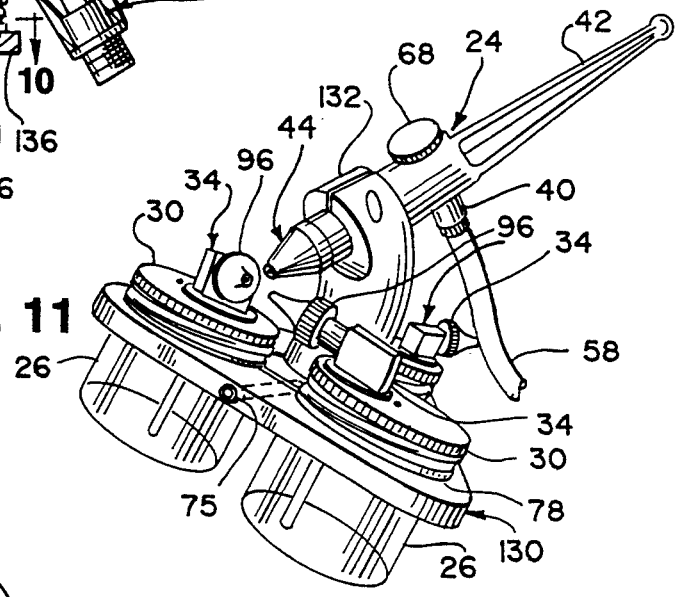
Fig. 11
Fig. 10
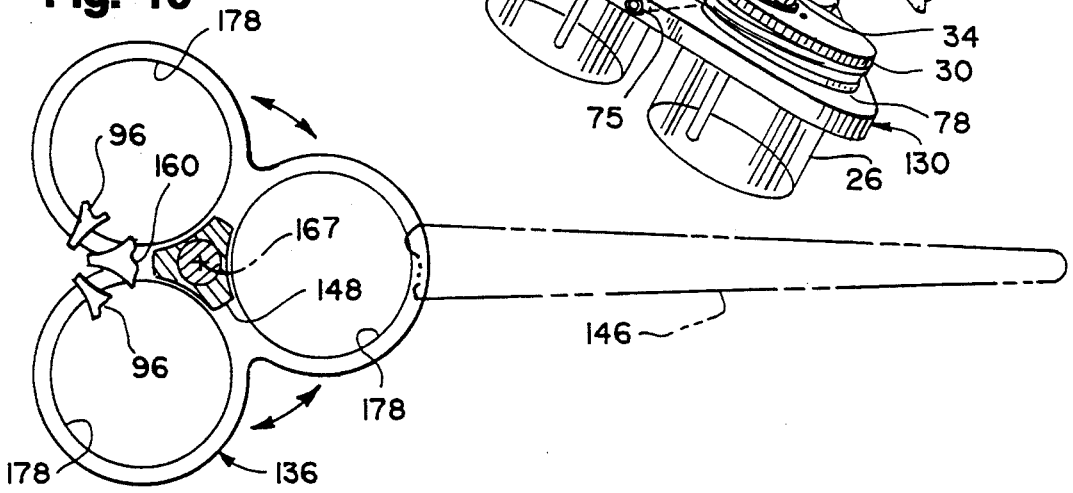

SPRAYING APPARATUS FOR BLENDING LIQUIDS IN A GASEOUS SPRAY SYSTEM

BACKGROUND OF THE INVENTION

This invention relates to apparatus adapted for blending liquids in a gaseous spray stream, more particularly, to such apparatus which functions to aspirate liquids into a gas jet externally of the apparatus for spraying an object with the resulting spray mixture.

Spraying apparatus in which liquids are supplied internally to a gaseous stream for spraying an object with the resulting mixture have long been provided. Internal supply of liquids to a gaseous stream with the liquids internally blended in the stream has certain disadvantages. Among others, the internal spaces containing liquids may present a cleaning problem, such as when it is desired to change the liquids in the apparatus. The problem may be more acute employing reactive liquids, for example, two-component epoxy paints. Relatively complex and precise blending apparatus is required in order to provide for variations in mixing ratios of the liquids.

Numerous sprayers have been provided that operate by external aspiration of a fluid utilizing the suction effect of a gas jet. It appears that the sprayers of this type have aspirated but a single stream of liquid, although it was known to blend two liquids prior to aspiration into the stream to be aspirated. It has also been known to externally produce a spray mixture by supplying pressurized liquids to a gas jet.

SUMMARY OF THE INVENTION

The present invention provides a spraying apparatus which is both versatile in its applications and simple and economical in manufacture and use. It eliminates the aforesaid disadvantages of apparatus in which liquids are mixed internally. It is, moreover, adapted to be made in a lightweight assembly which is especially useful as a hand-held sprayer, such as an airbrush assembly. The apparatus is very simple and easy to adjust, for spraying liquids in various ratios from 0 to 100 percent of any liquid, with corresponding variation in the proportion or ratio of another liquid or liquids.

The invention may be employed for spraying such liquid mixtures as liquid paints, gardening chemicals and the like, coating materials, materials to be atomized into the atmosphere, and others that are mixed in varying proportions. When used for blending colors, as in a paint sprayer, colors may be easily and rapidly interchanged in the apparatus, or, in a convenient embodiment, the three primary colors of paints, i.e., red, yellow, and blue, may be carried by the apparatus and mixed in various ways to produce sprays in the secondary colors, while, alternatively, any one of the primary colors may be sprayed alone.

In its preferred embodiments, the invention provides an improvement in a spraying apparatus adapted for blending liquids in a gaseous spray stream, which apparatus includes gas nozzle means and mounting means therefor, the gas nozzle means being adapted for discharging a gas jet to be directed at an object to be sprayed, the improvement including a plurality of liquid nozzle means each including suction outlet means adapted for removal of liquid therefrom by aspiration, and mounting means for each of the liquid nozzle means adapted for disposing the nozzle means relative to the gas jet to effect aspiration of liquid from the outlet means of the liquid nozzle means together with aspiration of liquid from the outlet means of the remaining liquid nozzle means into the gas jet, at least one of (a) the mounting means for the gas nozzle means and (b) a mounting means for a liquid nozzle means being adapted for varying the disposition of the liquid nozzle means relative to the gas jet to thereby vary the rate of aspiration from the outlet means of the liquid nozzle means relative to the rate of aspiration from the outlet means of another liquid nozzle means.

In further preferred embodiments, the apparatus includes a support, the gas nozzle means and the liquid nozzle means are mounted on the support, and liquid container means also are mounted on the support.

The foregoing and other objects, advantages, features and functions of the invention will be apparent from the description which follows and upon reference to the drawings forming a part hereof.

BRIEF DESCRIPTION OF THE DRAWINGS

The drawings illustrate preferred embodiments of the invention, without limitation thereto. In the drawings, like elements are identified by like reference characters in each of the views, and:

FIG. 1 is a top and front perspective view of a preferred embodiment of the spraying apparatus in accordance with the invention;

FIG. 2 is an enlarged fragmentary side elevational and partly sectional view of the embodiment of FIG. 1, with the section taken substantially along the axis of a gas gun component thereof;

FIG. 3 is a side elevational view of support and mounting components of the embodiment of FIG. 1;

FIG. 4 is a top plan view of the components of FIG. 3;

FIG. 5 is a rear elevational view of the components of FIG. 3;

FIG. 6 is an enlarged side elevational and partly sectional view of a liquid container and a liquid nozzle mounted thereon, in the embodiment of FIG. 1;

FIG. 7 is a fragmentary top plan view of components of the embodiment of FIG. 1, illustrating relationships of a gas nozzle and the liquid nozzles therein;

FIG. 8 is a front perspective view of a second preferred embodiment of the spraying apparatus of the invention;

FIG. 9 is a side elevational and partly sectional view of the embodiment of FIG. 8, the section being taken substantially along the axis of a gas gun component thereof;

FIG. 10 is a fragmentary sectional view of the second embodiment, taken substantially on line 10–10 of FIG. 9; and FIG. 11 is a front perspective view of a third preferred embodiment of the invention.

DESCRIPTION OF THE PREFERRED EMBODIMENTS

Referring to the drawings, particularly FIGS. 1–7, a spraying apparatus or sprayer 20 is a hand-held assembly of a yoke-like support 22, a gas gun 24 mounted on the support, two liquid containers or bottles 26 mounted on the support, two closure caps 30 threadedly engaging or screwed on the necks of respective containers 26, and a liquid supply assembly 34 on each of the closure caps 30.

The spraying apparatus 20 is especially adapted for use as an airbrush assembly or the like, wherein the gas gun 24 may be a conventional air gun, supplied with compressed air, carbon dioxide, nitrogen or other suitable gas. The remaining components of the apparatus may be supplied as an attachment to the conventional gun.

Referring particularly to FIG. 2, illustrative gas gun 24 includes a molding 36 preferably made from a polymeric resin or plastic, and the molding includes as integral components a tubular body 38, a tubular gas inlet 40 projecting laterally from the body, and a handle 42 extending rearwardly from the body. A gas nozzle 44 has a conical head 46 and a threaded shank 48, and preferably is made of a suitable metal. The shank 48 is threadedly received in an internally threaded mouth 50 of the body 38 at the front end thereof. A cylindrical axial orifice 52 in the head 46 communicates with the interior of the tubular body 38, and serves to discharge a gas jet forwardly in the direction of its axis, towards an object to be sprayed.

A hose fitting 54 is received in an open outer end of the gas inlet 40, and secured therein by a force fit or other suitable means. A threaded outer end 56 of the fitting serves to threadedly engage a pressure hose or tube 58 (FIG. 1), which is connected to a suitable source of pressurized gas (not shown), such as air, for supplying the gas in a conventional manner.

The interior of the gas inlet 40 communicates with the interior of the body 38 through a valve opening 60 providing a passageway therebetween. A valve seat 62 is formed around the opening. The valve opening 60 is opened and closed by means of a valve 64 mounted on the inner end of a valve stem 66, which extends through the body 38. The valve is operated by means of a finger button 68 mounted externally on the outer end of the stem 66, and spring-pressed outwardly to close the valve, by means of a helical coil compression spring 70 mounted around the stem 66 between the button 68 and the body 38.

Referring particularly to FIGS. 3–5, the support 22 is a flat plate-like structure having two spaced apart shallow cylindrical container-receiving openings 72 of equal diameter extending therethrough. A narrow slot or gap 74 in the support 22 extends between the openings 72. The slot is bridged by a setscrew 75 extending rearwardly in a cylindrical opening 76 in a front part of the support 22 and into threaded engagement in a tapped opening 77 in a rear part of the support. The diameter of the openings 72 in the unstressed support is slightly greater than the outside diameters of the containers 26, for receiving the containers rotatably in upright positions therein. Upon tightening the setscrew 75, the slot 74 is narrowed, thereby slightly reducing the diameters of the support openings 72, to cause the walls of the openings 72 to grip the outer surfaces of the containers 26 tightly in frictional engagement and prevent the containers from being rotated readily.

In the illustrative preferred embodiment, the closure caps 30 have the same construction, and the rim 78 of each has a greater external diameter than the outside diameter of the containers 26 (see FIG. 6). The diameter of the rim 78 is also greater than the diameters of the support openings 72, so that the caps will not go through the openings. Consequently, with the caps 30 screwed on the tops of the containers 26 and the containers inserted fully through the openings 72 from above, the rims 78 of the caps seat on the adjacent, generally upper surface of the support 22, to fix the elevations of the liquid supply assemblies 34 on the caps (see FIGS. 1 and 2).

A gun mount 80 in the form of a metal block is fixedly secured on the upper surface of the support 22 by means of a setscrew 82 extending through the support into threaded engagement with the base of the mount (see FIG. 2). A cylindrical gun-mounting opening 84 extends through the upper portion of the mount 80, in an axial direction from front to rear on the support 22. The upper portion of the mount 80 is bifurcated, and a stress relief opening 86 is provided in the lower portion of the mount. A clamping setscrew 88 extends through one bifurcation of the mount 80 into a tapped opening 90 in the other bifurcation, bridging a narrow slot or gap 92 therebetween. The mounting opening 84 receives the molding body 38 of the gun 24 loosely therein, and the gun is clamped in place by tightening the setscrew 88 and thereby reducing the diameter or size of the opening 84. As thus mounted, the gas nozzle 44 is disposed to direct a gas jet from its orifice 52 midway between the container-receiving openings 72 and thus between the containers 26, and the closure caps 30 thereon (see FIGS. 1, 4 and 7).

Referring to FIG. 6, each liquid supply assembly 34 includes a mounting holder or block 94, and a liquid nozzle 96 and a tubular liquid conduit 98 secured thereto. The nozzle 96 has an axial cylindrical orifice or liquid passageway 100 therein, extending from a suction inlet opening 102 in a shank 104 of the nozzle 96, to a suction outlet opening 106 at the outer end of the nozzle. The shank 104 is threaded, and is in threaded engagement with a tapped opening 108 in the holder 94. The axial disposition of the liquid nozzle 96 in the holder 94 may be adjusted by threading the shank 104 into or out of the opening 108.

A second tapped opening 110 is provided in the holder 94, and it intersects the first opening 108 at a preferred angle of about 135 degrees. The normally upper end 112 of the liquid conduit 98 is threaded, and it is threadedly received in the second tapped opening 110, where the interior of the conduit communicates with the suction inlet opening 102 of the nozzle 96. The bottom of the conduit 98 extends to a location closely spaced above the bottom of the liquid container 26, where liquid is removed from the container through the open end of the conduit by suction. As will be described hereinafter, suction is applied to the suction outlet opening 106 of the nozzle 96, thereby to aspirate liquid from the container, through the conduit 98 and the nozzle orifice 100.

The holder 94 is tightly mounted on a closure cap 30 for rotation therewith. When the cap is screwed tightly on a container 26, the cap and the holder rotate with the container, and likewise the nozzle 96 rotates with the container. The holder 94 is secured in essentially fixed position by means of a mounting nut 114 in threaded engagement with the upper end 112 of the conduit 98. The nut 114 bears on a washer 116 around the conduit, which in turn bears on a fibrous material cap liner 118 on the inner surface of the cap. The holder 94 is seated on a second washer 120, in turn seated on the outer surface of the closure cap. A vent hole 122 extends through each cap 30 and its liner 118, for equalizing the pressure in the interior of the container 26 with the atmospheric pressure upon application of suction to the liquid nozzle 96.

In using the spraying apparatus 20 as an airbrush assembly, for example, the containers 26 may be loaded with two differently colored paints, such as two of the primary paint colors, red, yellow and blue. Any two of the three colors may be paired, depending on the color it is desired to spray. Containers having the two selected colors are closed with their caps 30, having the liquid supply assemblies 34 thereon. The containers are inserted into the support openings 72 from above, until the cap rims 78 seat on the upper surface of the support 22.

Initially, each of the liquid nozzles 96 is adjusted relative to the axis of the gas nozzle 44 and its discharge orifice 52 so as to produce a desired result. If it be desired to blend the two colors in equal proportions in the air stream that will issue from the orifice 52, the containers 26 will be rotated manually until the two liquid nozzles 96 are focused alike on the axis of the gas nozzle 44 and its orifice 52, so that they appear substantially as mirror images of each other. In so doing, the axes of the liquid nozzles 96 preferably intersect the axis of the gas nozzle 44. In accomplishing this result, it may be necessary to both rotate a container 26, and axially adjust the position of its liquid nozzle 96 with respect to its holder 94, threading the nozzle shank 104 into or out of the corresponding holder opening 108. With the liquid nozzles 96 properly oriented, the setscrew 75 in the support is tightened, to tighten the rims of the support openings 72 around the containers 26 and hold them in place.

When the containers 26 are loaded with red and blue paints, respectively, the pressure hose 58 is connected to a source of pressurized air, e.g., air at 45 p.s.i.g., and the valve button 68 is pressed. The air jet issuing from the gas nozzle 44 aspirates paint approximately equally from the outlet openings 106 of the two liquid nozzles 96, and atomizes the liquids in a spray mixture that is purple in color. If the desired spray is not obtained at the initial settings, adjustments may be made in the disposition of any of the nozzles. Thus, the body 38 of the gas gun 24 may be shifted axially in its mount 80, upon loosening the clamping setscrew 88, following by tightening the screw to hold the gas nozzle 44 firmly in an adjusted position. Each of the liquid nozzles 96 may be adjusted axially relative to its holder 94, as explained hereinabove. Either or both of the containers 26 may be rotated in the support 22, upon loosening the setscrew 75, and retightening the same after adjustment.

Referring to FIG. 7, either of the liquid nozzles 96 may be rotated from the foregoing position in a direction away from the gas nozzle 44, in a arcuate path, to reduce the proportion of that color relative to the other, up to the point that one liquid nozzle is completely beyond the influence of the air jet from the nozzle 44, at which time a single pure color will be aspirated from the remaining liquid nozzle and sprayed.

Other primary and secondary colors may be sprayed in like manner, by substituting and pairing containers having any two of the three primary colors, i.e., red and yellow may be paired, and blue and yellow may be paired. Each time a change is desired, the support setscrew 75 may be loosened, and either of the containers 26 removed, and a container with the remaining primary color, yellow in this case, may be mounted in a opening 72 on the support in place of the removed container.

By reducing the air pressure, e.g., to about 15 p.s.i.g., a stipple effect may be created on the object being painted. Since in other prior methods, such an effect has been produced by using paints in two different solvents, such as oil and water, and spraying from a single source pressure pot, the use of the apparatus of the present invention will reduce air pollution by eliminating oil-based paint.

The embodiments of FIGS. 8–11 are representative of spraying apparatus, particularly airbrush assemblies, which carry all three of the primary paint colors, any two of which may be paired for spraying together. It is a distinct advantage that no cleanup is required between color changes, inasmuch as only pure colors are present in the containers and their liquid supply assemblies, and all mixing is done externally, in the atmosphere.

The embodiment of FIG. 11 constitutes, in general, a modification of the embodiment of FIGS. 1–7. Thus, a support 130 is similar to the support 22 in FIGS. 1–7, but is tripartite, for supporting three containers 26, each having a liquid supply assembly 34 mounted on a closure cap 30 for rotation with the cap and its container. In this structure, a modified gun mount 132, similar to the mount 80 of FIG. 1 is provided, and it supports the gas gun 24 so that its axis extends angularly with respect to the upper surface of the support 130. When it is desired to use a different pair of liquid containers, the mount 132 may be loosened on the support 130, for relative rotation of the support and positioning of the new pair of liquid supply assemblies 34 with respect to the gas nozzle 44. This may be accomplished by fastening the gun mount 132 onto the support 130 by means of a setscrew 82, in the manner illustrated in FIGS. 2 and 5 with respect to the mount 80 and support 22, and loosening the screw when rotation is desired. As in the embodiment of FIGS. 1–7, a setscrew 75 and accompanying support structure is provided for each pair of liquid containers 26, to enable loosening and tightening of the support 130 around the containers.

The embodiment of FIGS. 8–10 is a further modification of FIGS. 1–7 and 11. The principal differences reside in the manner of mounting a gas gun 134 on the yoke-like support 136 of a spraying apparatus 140, and clamping the containers 26 in place.

A molding 142 of the gun 134 includes a tubular body 144, a handle 146 extending rearwardly therefrom, a tubular gas inlet 147 projecting laterally from the body, and a trunk 148 at the front end of the body. The trunk has a bore 150 extending upwardly from its base, and a counterbore 152 in its upper portion. The body 144, otherwise generally of the same construction as the body 38 in the embodiment of FIGS. 1–7, includes a passageway 154 communicating with the counterbore 152 at its front end, and with the interior of the tubular gas inlet 147 at its rear end. The front end of the body 144 has a threaded opening 158, which receives a gas nozzle 160 in threaded engagement therein. The gas nozzle terminates in a gas discharge orifice 162, supplying pressurized gas in a direction axially thereof.

The gun 134 is mounted on the support 136 by means of a carriage bolt 164 or the like extending through the bore 150 and the counterbore 152. The bolt also extends through an axial opening in a spool 165 seated in the counterbore 152 and providing a gas passage therearound. The head of the bolt is anchored in the support 136 at the axis 167 thereof, and the threaded shank 168 of the bolt projects upwardly from the molding body 144. The bolt is secured by a cap nut 170 threadedly engaging the projecting end of the shank 168.

The trunk 148 is formed to provide a clamping projection 172, which extends laterally over the closure caps 30, for clamping them and the containers 26 in place when the nut 170 is tightened on the bolt 164. At the same time, the spool 165 is clamped in place, to prevent rotation thereof.

Referring to FIG. 10, the openings 178 in the support 136 are centered at the apices of an equilateral triangle having its center at the axis 167 of the support. The gas gun 134 is mounted on the support 136 for rotational movement of the gun and the support relative to each other substantially about such center of the triangle, for disposing the gas nozzle 160 to direct the gas jet therefrom between any two of the openings 178, and thus between any two of the containers 26 and the nozzles 96 thereon. The embodiment of FIG. 11 is similar in these respects. Upon loosening the nut 170, the support 136 and the containers 26 are released for rotation, the support about its axis 167 and the individual containers about their axes. At this time, the support 136 and the gun 134 may be rotated relative to each other, to dispose a selected pair of containers 26 with the liquid nozzles 96 thereon on opposite sides of the gas nozzle 160, for aspiration from the liquid nozzles, as seen in FIG. 10. As in the preceding embodiments, the containers 26 may be rotated to position the liquid nozzles 96 as desired relative to the gas nozzle 160, and moved to and from the gas nozzle similarly to the use of the apparatus 20 of FIGS. 1–7, as illustrated in FIG. 7. In the embodiment of FIGS. 8–10, the operation is the same with any pair of the containers 26 and their liquid nozzles 96 disposed in the illustrated relationship to the gas nozzle 160. Each liquid nozzle 96 also may be adjusted on its holder 94.

When the desired changes have been made, the nut 170 may be tightened on the bolt 164, to clamp the components of the apparatus in fixed positions, as before. The location of the gas gun 134 relative to the containers 26 as desired may be facilitated by locator or indexing markings (not shown) on the trunk 148 and the support 136, respectively.

In view of the fact that the gas gun of each of the embodiments of spraying apparatus, including the embodiment of FIGS. 1–7, may be rotated with respect to the liquid nozzles 96, which may remain in stationary positions on their supports or which also may be rotated thereon, variations in the rates of aspiration from the outlet openings of the liquid nozzles, and corresponding variations in the composition of the spray mixture, may be caused by rotating the gun on its support. However, for varying the rates of aspiration, it is preferred to maintain the gun stationary on its support while the dispositions of the liquid nozzles thereon are varied.

While preferred embodiments of the invention have been illustrated and described, it will be apparent to those skilled in the art that various changes and modifications may be made therein. It is intended that all such changes and modifications be included within the scope of the claims.

I claim:

1. A spraying apparatus adapted for blending liquids in a gaseous spray stream, which comprises:

a support, gas nozzle means adapted for discharging a gas jet to be directed at an object to be sprayed, means mounting said gas nozzle means on said support, a plurality of liquid container means, means movably mounting each of said liquid container means on said support, a plurality of liquid nozzle means each including suction inlet means and suction outlet means, said suction outlet means being adapted for removal of liquid therefrom by aspiration, and means mounting said plurality of liquid nozzle means on respective ones of said plurality of liquid container means for movement of each liquid nozzle means with the corresponding liquid container means and in communication of said suction inlet means of the liquid nozzle means with the interior of the container means for suction flow of liquid from the container means to the suction inlet means, whereby the suction outlet means of each of said liquid nozzle means may be moved in respective directions to and from said gas jet to thereby dispose the suction outlet means relative to said gas jet to effect aspiration of liquid from the suction outlet means of the plurality of liquid nozzle means into the gas jet at rates which vary with respect to each suction outlet means for spraying an object with the resulting spray mixture, said means mounting said plurality of liquid nozzle means on respective container means including means for adjusting the disposition of each liquid nozzle means relative to the container means on which it is mounted and thereby to said gas jet.

2. A spraying apparatus adapted for blending liquids in a gaseous spray stream, which comprises:

a yoke-like support having a plurality of openings therein, gas nozzle means adapted for discharging a gas jet to be directed at an object to be sprayed, means mounting said gas nozzle means on said support, a plurality of liquid bottles received in respective ones of said openings in said support rotatably on said support, a closure cap on each of said bottles, a plurality of liquid nozzle means each including suction inlet means and suction outlet means, said suction outlet means being adapted for removal of liquid therefrom by aspiration, and means mounting said plurality of liquid nozzle means on respective ones of said closure caps for rotation of each liquid nozzle means with the corresponding bottle and in communication of said suction inlet means of the liquid nozzle means with the interior of the bottle for suction flow of liquid from the bottle to the suction inlet means, whereby the suction outlet means of each of said liquid nozzle means may be rotated in respective directions to and from said gas jet to thereby dispose the suction outlet means relative to said gas jet to effect aspiration of liquid from the suction outlet means of the plurality of liquid nozzle means into the gas jet at rates which vary with respect to each suction outlet means for spraying an object with the resulting spray mixture.

3. A spraying apparatus as defined in claim 2 and wherein said means mounting said plurality of liquid nozzle means on respective closure caps includes means for adjusting the disposition of each liquid nozzle means relative to the closure cap on which it is mounted and thereby to said gas jet.

4. An airbrush assembly adapted for blending paints of different colors in a gaseous spray stream, which comprises:

a yoke-like support having a plurality of openings therein, gas nozzle means adapted for discharging a gas jet to be directed at an object to be sprayed, means mounting said gas nozzle means on said support, a plurality of paint bottles received in respective ones of said openings in said support rotatably on said support, a closure cap on each of said bottles, a plurality of paint nozzle means each including suction inlet means and suction outlet means, said suction outlet means being adapted for removal of liquid paint therefrom by aspiration, and means mounting said plurality of paint nozzle means on respective ones of said closure caps for rotation of each paint nozzle means with the corresponding bottle and in communication of said suction inlet means of the paint nozzle means with the interior of the bottle for suction flow of liquid paint from the bottle to the suction inlet means, whereby the suction outlet means of each of said paint nozzle means may be rotated in respective directions to and from said gas jet to thereby dispose the suction outlet means relative to said gas jet to effect aspiration of paint from the suction outlet means of the plurality of paint nozzle means into the gas jet at rates which vary with respect to each suction outlet means for spraying an object with the resulting spray mixture.

5. An airbrush assembly as defined in claim 4 and wherein each of said means mounting a paint nozzle means on a closure cap includes means for adjusting the disposition of the paint nozzle means relative to said closure cap and thereby to said gas jet.

6. A hand-held airbrush assembly adapted for blending paints of different colors in a gaseous spray stream, which comprises:

a yoke-like support having three openings therein at the apices of an equilateral triangle, a gas gun having an inlet for pressurized gas, gas nozzle means communicating with said gas inlet, and a handle, said gas nozzle means being adapted for discharging a gas jet to be directed at an object to be sprayed, means mounting said gas gun on said support for rotational movement of the gas gun and the support relative to each other substantially about the center of said triangle for disposing said gas nozzle means to direct said gas jet between any two of said openings, three paint bottles received in respective ones of said openings in said support rotatably on said support, a closure cap on each of said bottles, three paint nozzle means each including suction inlet means and suction outlet means, said suction outlet means being adapted for removal of liquid paint therefrom by aspiration, and means mounting said three paint nozzle means on respective ones of said closure caps for rotation of each paint nozzle means with the corresponding bottle and in communication of said suction inlet means of the paint nozzle means with the interior of the bottle for suction flow of liquid paint from the bottle to the suction inlet means, whereby the suction outlet means of each of said paint nozzle means may be rotated in respective directions to and from said gas jet to thereby dispose the suction outlet means relative to said gas jet to effect aspiration of paint from the suction outlet means of any two of said paint nozzle means into the gas jet at rates which vary with respect to each suction outlet means for spraying an object with the resulting spray mixture.

7. An airbrush assembly as defined in claim 6 and wherein each of said means mounting a paint nozzle means on a closure cap includes means for adjusting the disposition of the paint nozzle means relative to said closure cap and thereby to said gas jet.

* * * * *